United States Patent [19]

Coralline

[11] Patent Number: 4,620,739

[45] Date of Patent: Nov. 4, 1986

[54] BINGO CHIP BELL

[76] Inventor: William Coralline, 5235 W. Wabash Ave., Brown Deer, Wis. 53223

[21] Appl. No.: 682,692

[22] Filed: Dec. 17, 1984

[51] Int. Cl.[4] ..... A63F 9/00; B66C 1/04

[52] U.S. Cl. ..... 294/65.5; 273/148 R

[58] Field of Search ..... 294/65.5; 273/1 M, 148 R, 273/239, 269; 335/285, 293–295, 302

[56] References Cited

U.S. PATENT DOCUMENTS

| | | | |
|---|---|---|---|
| 2,417,762 | 3/1947 | Koller | 294/65.5 |
| 2,733,948 | 2/1956 | Russell | 294/65.5 |
| 2,733,949 | 2/1956 | Russell | 294/65.5 |
| 2,947,563 | 8/1960 | Stitt | 294/65.5 |
| 2,970,002 | 1/1961 | Liviano | 294/65.5 |
| 2,970,003 | 1/1961 | Heath et al. | 294/65.5 |
| 2,976,075 | 3/1961 | Budreck | 294/65.5 |
| 3,771,084 | 11/1973 | Thon | 294/65.5 X |

FOREIGN PATENT DOCUMENTS

| | | | |
|---|---|---|---|
| 929300 | 6/1955 | Fed. Rep. of Germany | 294/65.5 |

*Primary Examiner*—Johnny D. Cherry
*Attorney, Agent, or Firm*—Ronald E. Barry

[57] ABSTRACT

A bingo chip retrieving device including a molded cylindrical casing having a bottom wall and an open top, a cover closing the open top of the casing and having a cylindrical guide tube, a plunger mounted for reciprocal motion in the guide tube, a magnet mounted on the end of the plunger in the casing for attracting magnetically attractable chips against the bottom wall, and a spring connecting the guide tube to the plunger for biasing the magnet away from the bottom wall to release the chips from the magnetic force of the magnet.

7 Claims, 5 Drawing Figures

BINGO CHIP BELL

BACKGROUND OF THE INVENTION

Magnetic devices for removing magnetically attractable markers from game cards are presently available in many forms. Some of these devices merely involve a magnet on the end of a wand which requires that the magnetic pieces be removed either by hand or by sliding across the edge of a container. A number of devices are available wherein the magnet is moved away from a holding surface to reduce or eliminate the magnetic attraction of the magnet so that the pieces fall therefrom. Many of these devices are awkward to handle or have complicated means for removing the pieces.

SUMMARY OF PRESENT INVENTION

In accordance with the present invention there is provided a simple but effective device for picking up magnetically attractable markers or chips from a game board. The device is easy to assemble and manipulate and is capable of holding up to 100 chips.

IN THE DRAWINGS

DESCRIPTION OF THE INVENTION

Figure 2:
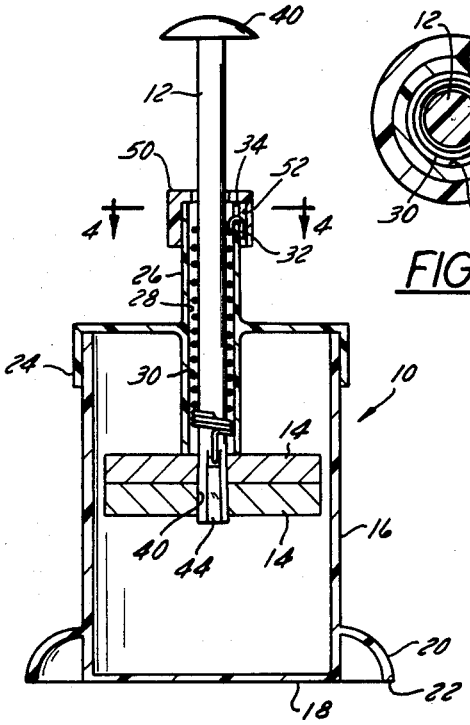
FIG. 2 is an elevation view in cross-section showing the magnet in the retracted position.
Figure 3:
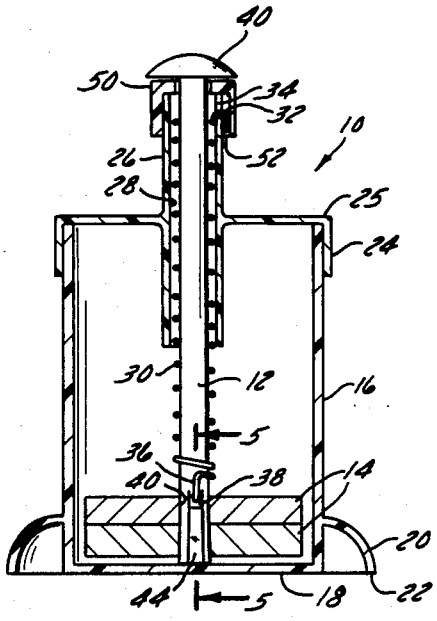
FIG. 3 is an elevation view in cross-section showing the magnet in the operative position.
Figure 5:
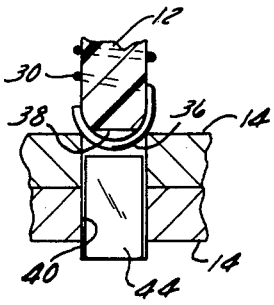
FIG. 5 is a view taken on line 5—5 of FIG. 3. showing the spring locked into the plunger by the wedge used to hold the magnet.

Referring to the drawings, the chip pickup device generally includes a casing 10, a plunger 12, and a magnet 14 mounted on the inner end of the plunger. In the retracted or normal position shown in FIG. 2, the magnet 14 is shown spaced from the bottom of the casing a distance sufficient to reduce the magnetic force to a level below that required to attract the chips. In FIG. 3 the device is shown in the operative or pickup position with the magnet 14 located in close proximity to the bottom of the casing so that the magnetic force is at a maximum and can pick up the chips. The chips are released by merely allowing the magnet to move to the retracted position.

The casing 10 is molded from a plastic material such as polystyrene having a cylindrical outer wall 16 and a flat bottom wall 18. Means are provided around the outer periphery of the lower portion of the outer wall to prevent chips from being attracted to the device when placed on a flat surface. Such means is in the form of an arcuate flange or skirt 20 which is molded as an integral part of the casing. The lower edge 22 of the skirt is coplanar with the bottom surface of the wall 18 to stabilize the device when placed on a flat surface.

The upper end of the casing is closed by means of a cover 25 which has a depending cylindrical flange 24 that matingly engages the outer surface of the upper portion of the cylinder 16. A tubular guide 26 is molded in the center of the cover 25 and has a cylindrical bore 28. A slot 34 is provided in the upper edge of the guide tube 26. The plunger 12 is mounted for reciprocal motion in the bore 28 of the tubular guide 26.

Means are provided for biasing the plunger 12 to a neutral position within the guide 26. Such means is in the form of a tension spring 30 which is positioned within the bore 28. The spring 30 is retained in the bore by means of an outwardly extending loop 32 provided at the upper end of the spring 30. The loop 32 is positioned in the slot 34 provided in the upper edge of the guide tube 26. The spring 30 is connected to the plunger 12 by means of an inwardly extending loop 36 located at the lower end of the spring 30.

In this regard it should be noted that the plunger 12 includes a slot 38 at the inner end and a button 40 at the outer end. The plunger is inserted into the bore 28 inside of the spring 30 and rotated until the loop 36 is seated in the slot 38. The plunger is then pushed downward to move the magnet 14 to the operative position. Means are provided on the plunger for limiting the inward motion of the plunger. Such means is the form of a button 40 which is provided on the end of the plunger in a position to engage the upper end of the guide tube 26 before the inner end of the plunger engages the inside surface of the bottom wall 18 in the casing. It should be noted that the casing is molded from a plastic material which could be damaged if the plunger were allowed to hit the bottom wall.

The magnet 14 includes a central aperture 40 which has a diameter slightly larger than the lower end of the plunger 12. The magnet is placed on the plunger and held thereon by means of a wedge 44 which is pushed into the slot 38 to expand the lower end of the plunger into tight engagement with the hole 40 in the magnet. The plunger is prevented from being removed from the guide tube 26 by the engagement of the magnet 14 with the bottom of the guide tube.

Figure 4:
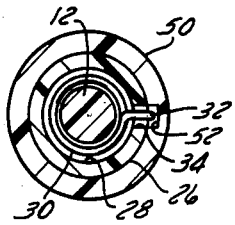
FIG. 4 is taken on line 4—4 of FIG. 2 showing the spring locked into the cap of the device.
Figure 1:
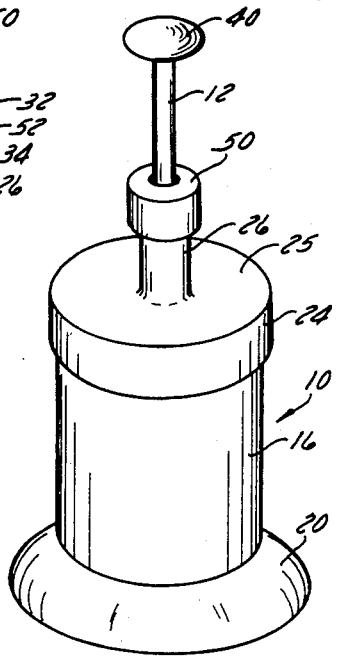
FIG. 1 is a perspective view of the chip pickup device.

The upper end of the guide tube is closed by means of a cap 50 which has an inner diameter slightly larger than the diameter of the guide tube 26. A slot 52 is provided on the inside surface of the cap 50 to provide room for the loop 32 as seen in FIG. 4. The cap 50 is secured to the guide tube 26 by applying an adhesive to the inside surface of the cap when it is mounted on the guide tube.

The embodiments of the invention in which an exclusive property or privilege is claimed, are defined as follows:

1. A bingo chip retrieving device comprising a cylindrical casing having a bottom wall and an arcuate flange around the outer periphery of the bottom portion of the casing, a cover having a depending flange to enclose the outer periphery of the top portion of the casing, a tubular guide in the center of said cover, a slot in the upper outer edge of the guide, a spring positioned in the tubular guide, said spring having an outwardly extending loop at one end positioned in said slot in said guide and an inwardly extending loop at the lower end, a plunger mounted for reciprocal motion in said guide, said plunger having a slot at the inner end to engage the inwardly extending loop of the spring, a magnetic member mounted on the end of the plunger, a wedge positioned in the slot in the end of the plunger for holding the magnet on the plunger, a cap on the outer end of said guide having a groove on the inside surface thereof for locking said outwardly extending loop on the spring in the guide, and a button on the outer end of the plunger to prevent the end of the plunger for engaging the bottom of the casing when the magnet is moved to the operative position whereby said magnet can be moved into close proximity to the bottom wall of the casing to magnetically attract magnetic chips and on release of the plunger said spring will retract the magnet to release the chips from the bottom wall of the casing.

2. The device according to claim 1 wherein said flange is located a distance from said lower portion of the casing sufficient to prevent chips from being attracted to the side wall of the casing.

3. The device according to claim 1 or 2 wherein the lower edge of said flange is coplanar with the bottom wall of the casing to stabilize the device.

4. A magnetic pickup device for removing magnetically attracted chips from a game board, said device comprising a casing having a flat bottom wall, a cover on said casing, a plunger supported for reciprocal movement in said cover, a magnet mounted on the plunger for movement toward and away from said bottom wall, spring means for biasing the plunger away from the bottom wall, and means on the outer perimeter of said casing for stabilizing the device on a flat surface whereby on movement of the magnet into close proximity to the wall, the magnetic force of the magnet will attract magnetically attractable chips into engagement with the bottom wall and on movement of the magnet away from the bottom wall, the chips will be released from the bottom wall.

5. The device according to claim 4 wherein said stabilizing means comprises a skirt around the outer perimeter of the casing and spaced a distance therefrom sufficient to prevent the magnet from attracting chips to the sides of the casing.

6. The device according to claim 4 or 5 wherein said cover includes a guide tube, said plunger being mounted for reciprocal motion in said guide tube, and said spring means comprising a tension spring having a loop at one end attached to the guide tube and a loop at the other end attached to the inner end of the plunger.

7. The device according to claim 6 including a cap on the outer end of the guide tube to lock the loop at said one end to the guide tube.

* * * * *